US007895782B2

(12) United States Patent
Farrell

(10) Patent No.: US 7,895,782 B2
(45) Date of Patent: Mar. 1, 2011

(54) LIGHT BOX DISPLAY APPARATUS CONFIGURED FOR FRONTAL ACCESS

(76) Inventor: Richard C. Farrell, Newport Beach, CA (US)

( * ) Notice: Subject to any disclaimer, the term of this patent is extended or adjusted under 35 U.S.C. 154(b) by 1096 days.

(21) Appl. No.: 11/514,095

(22) Filed: Aug. 31, 2006

(65) Prior Publication Data

US 2008/0120877 A1 May 29, 2008

(51) Int. Cl.
*G09F 13/04* (2006.01)

(52) U.S. Cl. ..... 40/575; 40/603; 40/604

(58) Field of Classification Search ..... 160/329, 160/368.1, 378, 389, 390, 404; 40/575, 603, 40/604, 611.11, 792, 794
See application file for complete search history.

(56) References Cited

U.S. PATENT DOCUMENTS 1,099,959 A * 6/1914 Wylie ..... 160/378
2,154,959 A * 4/1939 Roose ..... 40/626
3,390,259 A 6/1968 Angier
3,391,481 A 7/1968 Lloyd
6,390,170 B1 * 5/2002 Bringard et al. ..... 156/562
6,449,888 B1 * 9/2002 Gibbs ..... 40/575

* cited by examiner

*Primary Examiner*—Cassandra Davis
(74) *Attorney, Agent, or Firm*—Leonard Tachner

(57) ABSTRACT

A light box display configured for frontal access to change out graphics and to perform maintenance tasks. This is accomplished in the present invention while assuring that the graphics is held in a state of moderate tension to retain the graphics in a flat and properly oriented configuration. In the preferred embodiment, the light box comprises a moveable interior frame to which the graphics sheet and diffuser are both secured. The moveable interior frame rests on a plurality of upper and lower slides which facilitate movement of the inner frame. Such movement is controlled, in part, by at least one pneumatic piston which biases the frame toward the front of the light box and provides a mechanical lock that holds the frame in its rearward position to facilitate frontal access. The graphics sheet is held in place along the top and bottom front peripheral edges of the moveable frame by a plurality of spring-biased wire connection members within roller guides. One end of each wire member is attached to the rear peripheral surface of the moveable inner frame and the other end is threaded through a grommeted hole along the outer edge of the graphics sheet. Side spring-biased wire connection members are also provided.

15 Claims, 10 Drawing Sheets

LIGHT BOX DISPLAY APPARATUS CONFIGURED FOR FRONTAL ACCESS

BACKGROUND OF THE INVENTION

1. Field of the Invention

The present invention relates generally to the field of light box displays of the type used to present advertising comprising a replaceable graphics sheet positioned in front of a diffused light source. The invention pertains more specifically to such a light box uniquely configured to provide access only from the front of the display such as for changing the graphics or performing maintenance on the light box.

2. Background Art

Light boxes of the type disclosed herein have been in widespread use for at least the past forty years. See for example issued U.S. Pat. Nos. 3,390,259 and 3,391,481, both issued in 1968. Typically, such light boxes provide a rectangular housing having a distributed light source such as a plurality of spaced fluorescent tubes and a diffusing transparent or translucent surface for spreading the light evenly across the housing where it exits from a rectangular opening. Some form of graphics are provided either printed directly on the diffusing surface or on a flexible graphics sheet which is placed immediately in front of the diffusing surface.

In recent years, such light box displays have become more common as advertising systems as opposed to signs. Typically, advertising light boxes are wall mounted inside retail stores or where there is a great deal of foot traffic such as in airports, train stations, indoor malls and the like. Advertising light box displays normally utilize changeable graphics so that their advertising content can be modified relatively often. Such graphics are usually provided as a unitary flexible plastic film vinyl, paper, fabric or other substrate which has the advertising indicia printed on it and which is inserted into the light box in contiguous relation to the diffusing surface in front of the lighting source. The current trend appears to be to make such advertising light box displays quite large, such as four to six feet in height and eight to sixteen feet in length. They're typically four to twelve inches in thickness or depth. Conventional light box displays are simply affixed to the exterior surface of a wall. However, given the considerable cost of retail space, there is a growing desire to install light box displays inside recesses of a wall so that they don't extend beyond the wall's exterior surface. Such installations however create problems relating to access to the light box interior which is necessary to change out graphics and to perform maintenance such as replacing burned out light bulbs. Such access is normally gained from the side or rear of the light box or from a removable front element. However, side or rear access usually complicates the structure of the light box making it more expensive to manufacture. More importantly, side or rear access may require either that the light box be capable of being removed from its recess (which has significant impact on aesthetics and maintenance costs) or that some structural modifications be made to the surrounding wall to allow personnel to gain such access (which increases construction cost and may require wasteful use of costly retail space). Moreover, some retailers may wish to provide flush mounted light box surfaces which are overlapped by adjacent wall surfaces for aesthetics, thereby making it virtually impossible to provide front, side or rear access to the light box display.

Not having side or rear access to a flush mounted light box display, means that one must have frontal access to change the graphics and perform maintenance tasks. However, with the sheet of graphics being as large as the light box frontal area and being mounted flush with the front surface of the light box, it is not immediately apparent how to gain frontal access to replace the graphics or perform maintenance tasks. This is the problem that is addressed by the present invention.

SUMMARY OF THE INVENTION

The present invention, in its preferred embodiment, comprises a light box display configured for frontal access to change out graphics and to perform maintenance tasks. This is accomplished in the present invention while assuring that the graphics is held in a state of moderate tension to retain the graphics in a flat and properly oriented configuration.

In the preferred embodiment, the light box comprises a moveable interior frame to which the graphics sheet and diffuser are both secured. The moveable interior frame rests on a plurality of upper and lower slides which facilitate movement of the inner frame. Such movement is controlled, in part, by at least one pneumatic piston which biases the frame toward the front of the light box and provides a mechanical lock that holds the frame in its rearward position to facilitate frontal access. The graphics sheet is held in place along the top and bottom front peripheral edges of the moveable frame by a plurality of spring-biased wire connection members within roller glides. One end of each wire member is attached to the rear peripheral surface of the moveable inner frame and the other end is threaded through a grommeted hole along the outer edge of the graphics sheet. Side spring-biased wire connection members are also provided. The side wire members are interconnected to a common manual latch. This latch is closed to pull the sides of the graphics sheet taut and opened to release the sides of the graphics sheet when it is desired to push the moveable frame back to gain access to the light box interior. In other respects, the light box is relatively conventional in its operation in that it has a plurality of spaced apart fluorescent light tubes located towards the rear interior surface of the light box behind the moveable frame.

By employing a novel combination of a moveable interior frame, pneumatic pistons and spring-biased graphics sheet interface members, the disclosed embodiment provides a light box that is uniquely accessible from the front while assuring properly displayed graphics.

BRIEF DESCRIPTION OF THE DRAWINGS

The aforementioned objects and advantages of the present invention, as well as additional objects and advantages thereof, will be more fully understood herein after as a result of a detailed description of a preferred embodiment when taken in conjunction with the following drawings in which.

DETAILED DESCRIPTION OF A PREFERRED EMBODIMENT

Figure 1:
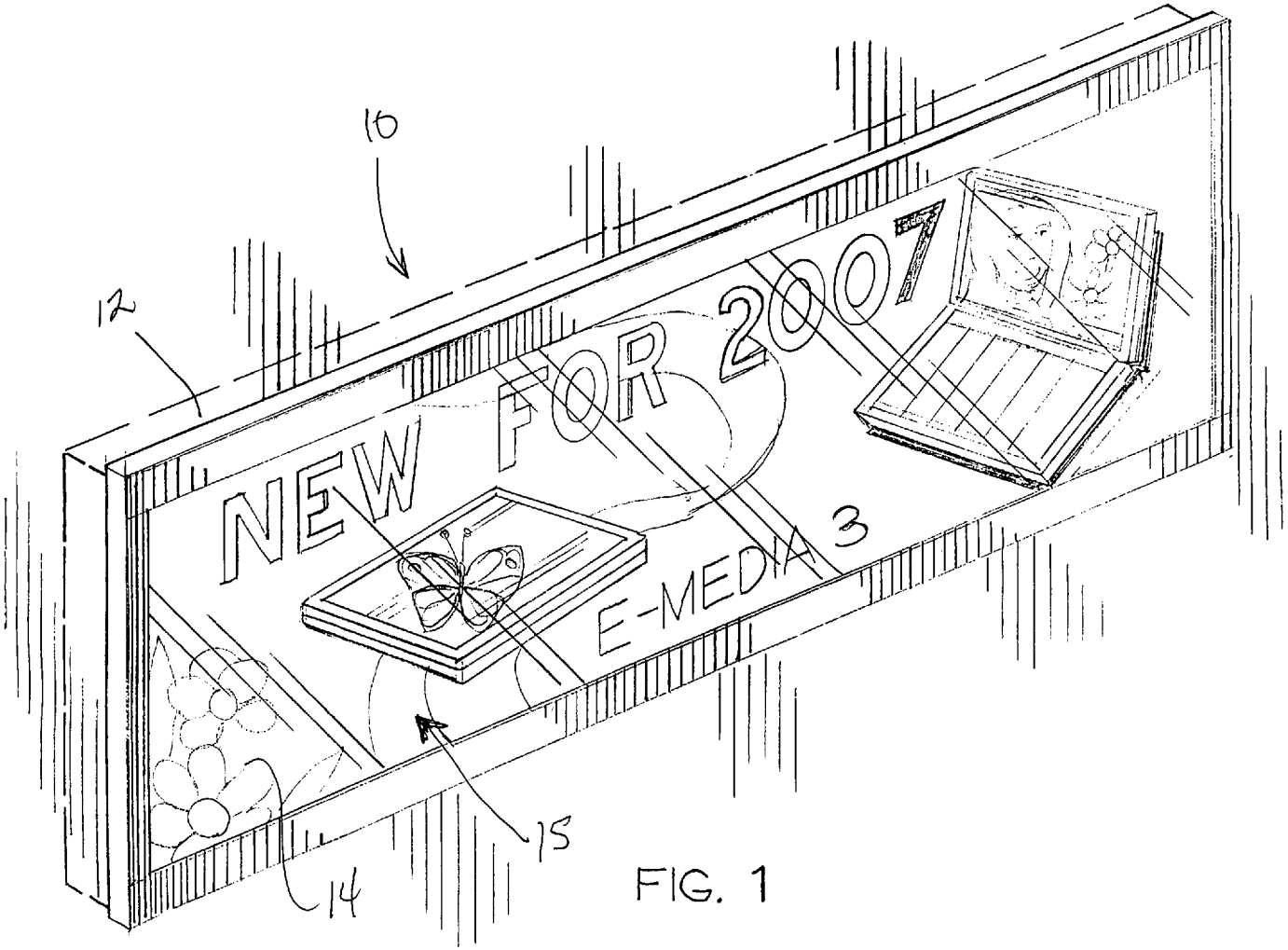
FIG. 1 is a perspective view of a preferred embodiment of the present invention.
Figure 2:
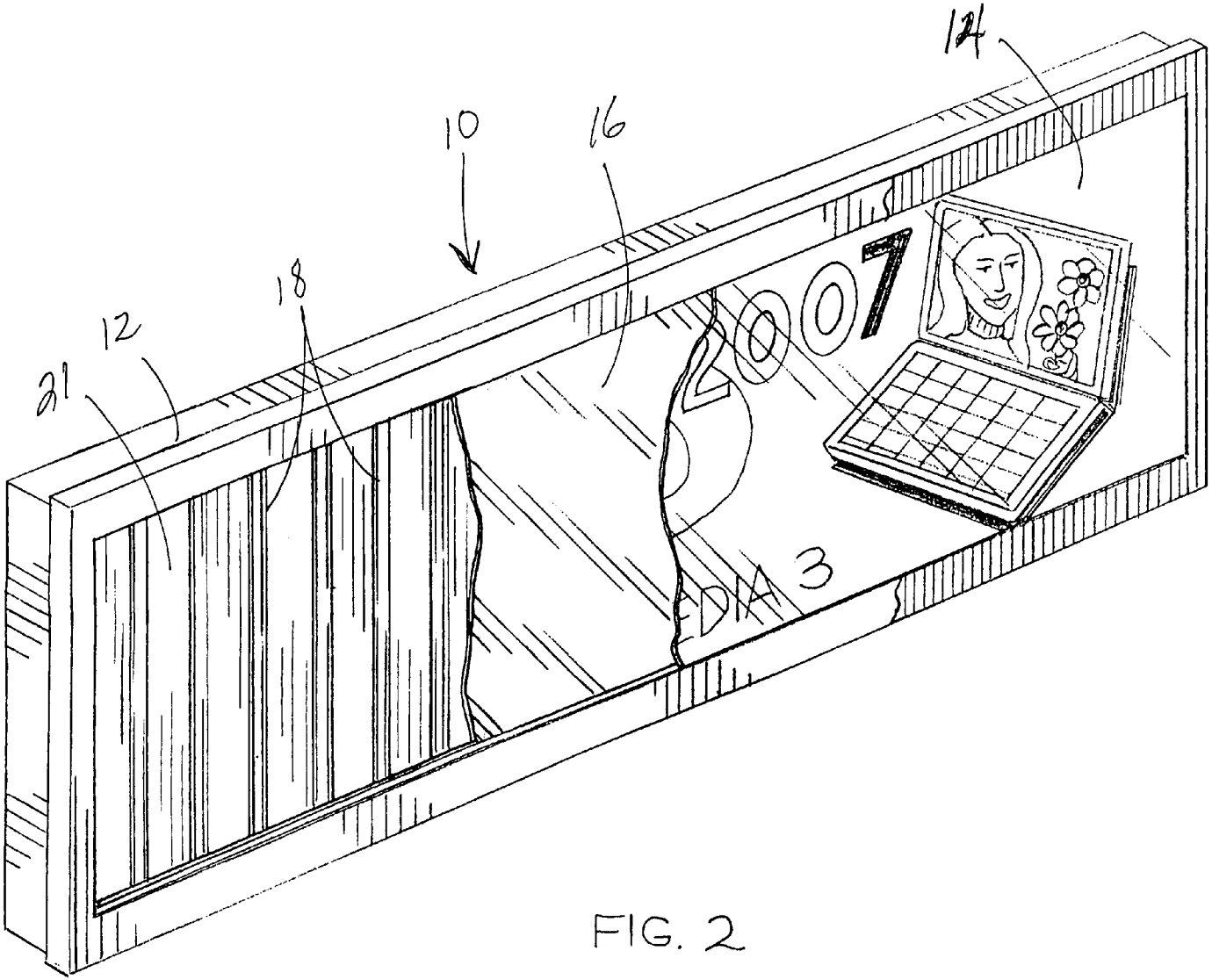
FIG. 2 is a view similar to that of FIG. 1, but showing certain components partially cut away to reveal the interior of the preferred embodiment.
Figure 3:
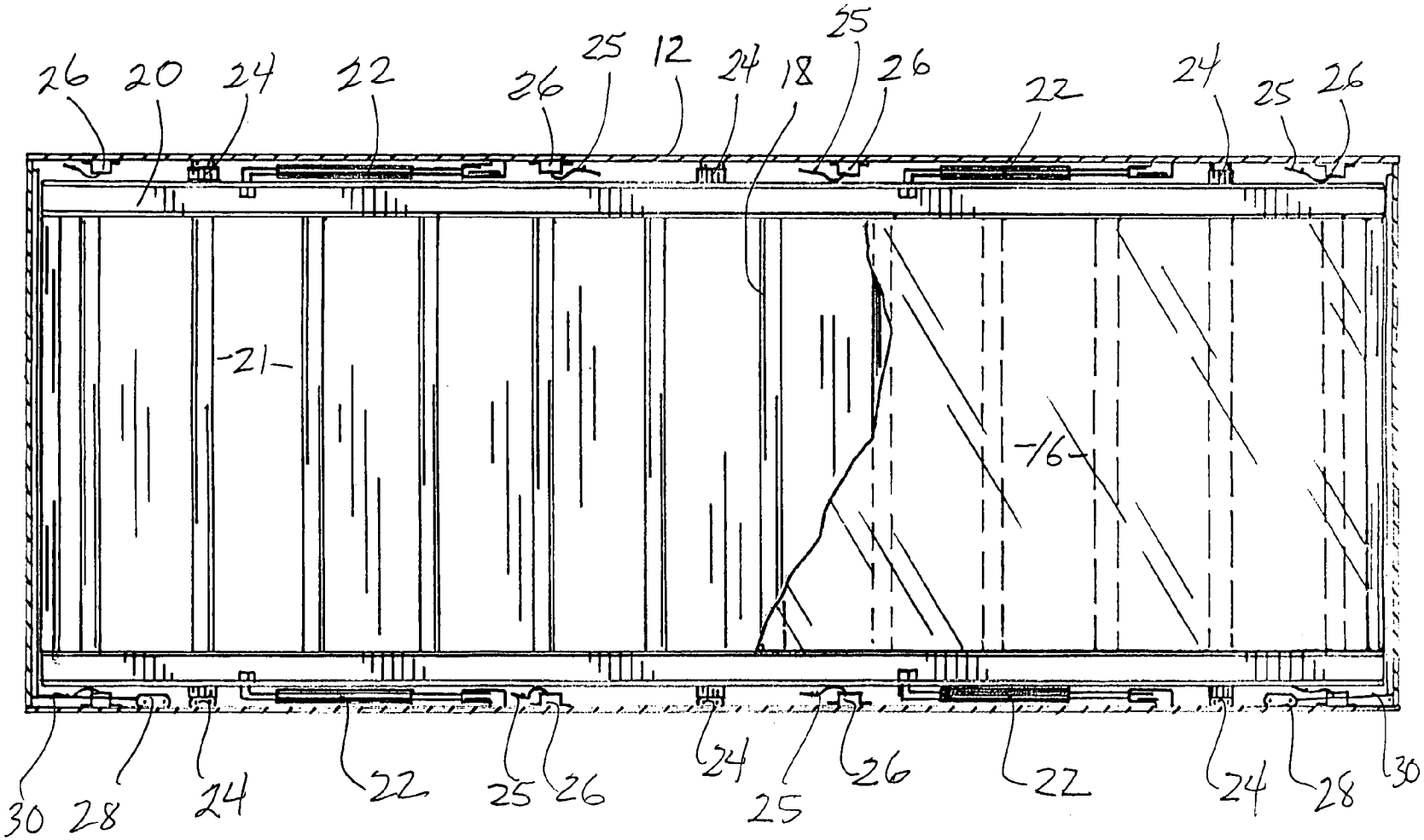
FIG. 3 is a front plan view of the preferred embodiment with the graphics sheet removed and the diffuser sheet partially cut away.

Referring to the accompanying drawings, it will be seen that a light box display apparatus 10 comprises a housing or outer frame 12 of substantially rectangular shape and forming a large front opening 15. As seen best in FIGS. 1 and 2, the apparatus 10 provides a graphics sheet 14 in front of a diffuser sheet 16. Sheets 14 and 16 fill the entire front opening 15 and reside in front of a light source comprising a plurality of fluorescent light bulb tubes 18 which are preferably positioned in a space apart parallel arrangement adjacent the back interior surface 21 of outer frame 12.

Figure 6:
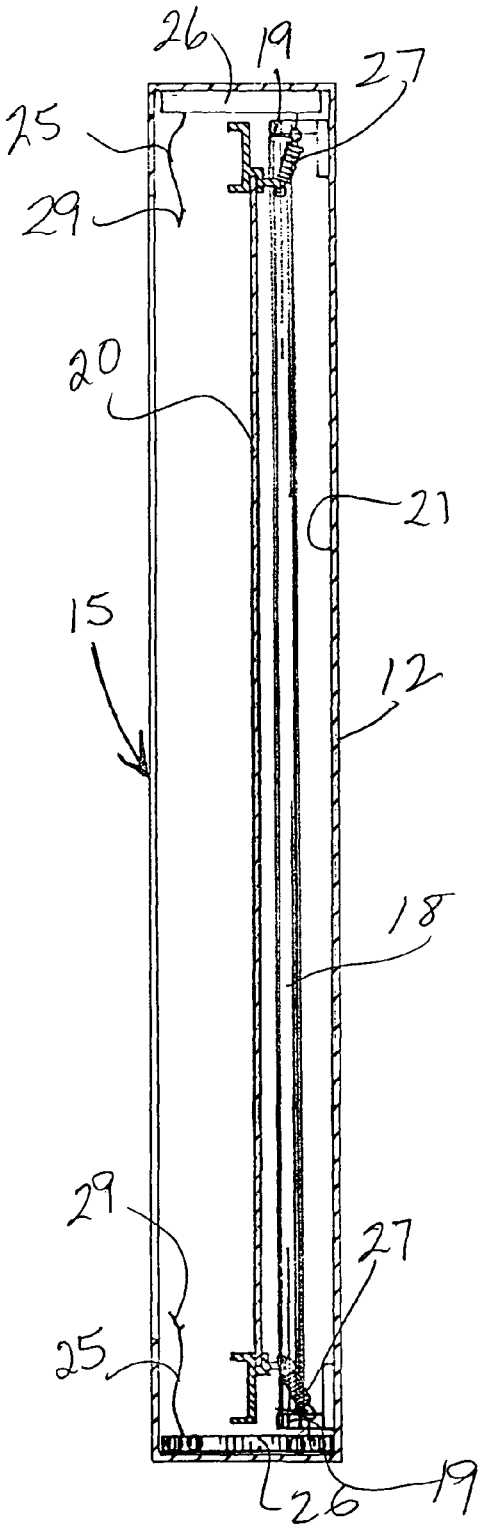
FIG. 6 is a side-directed cross-sectional view showing the front access condition.
Figure 7:
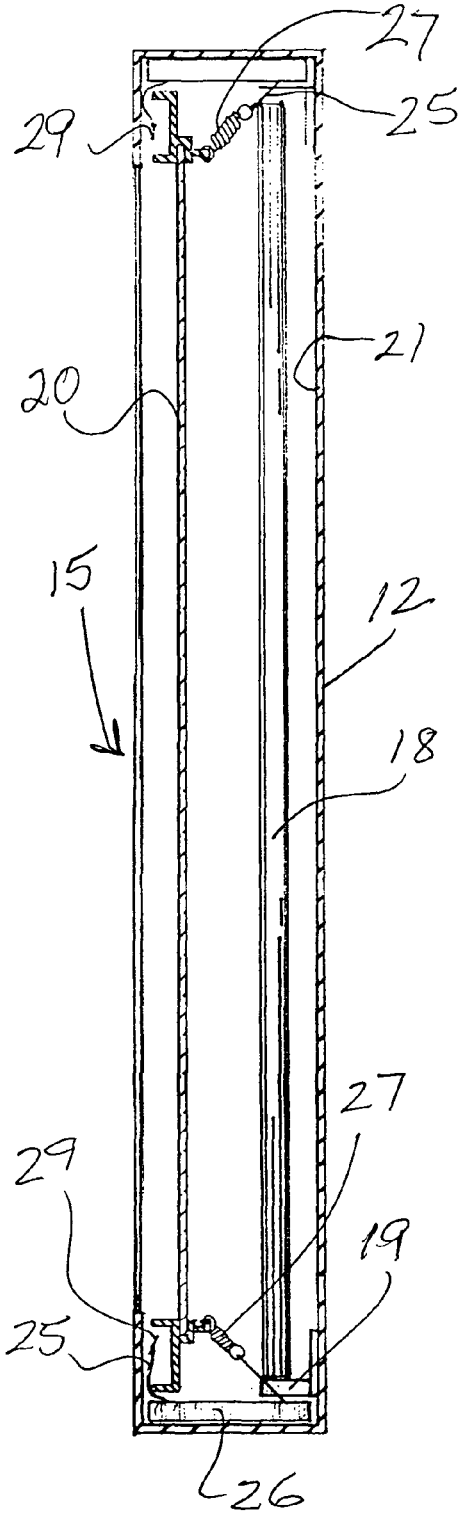
FIG. 7 is a side-directed cross-sectional view showing the normal display condition.
Figure 8:
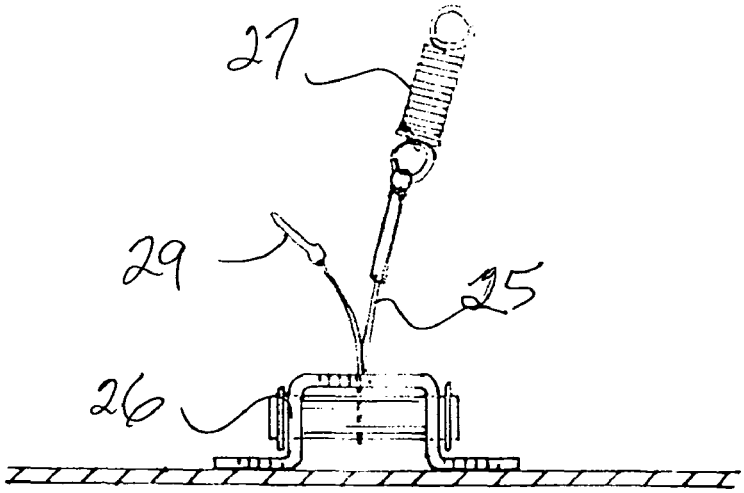
FIG. 8 is a front view of a connection member and connection guide of the preferred embodiment.
Figure 9:
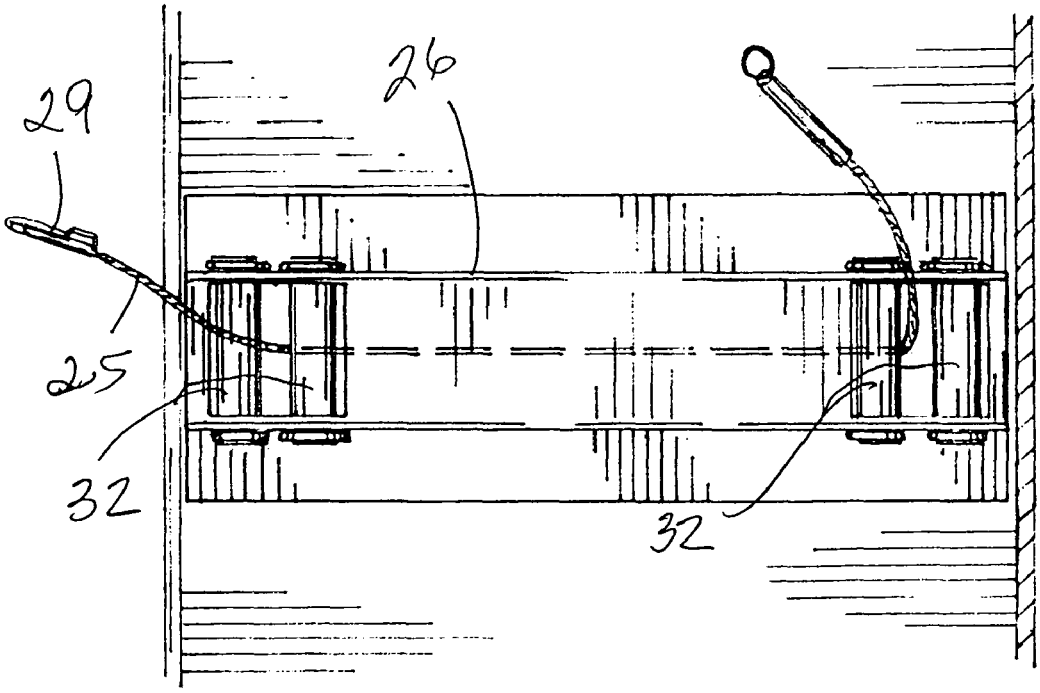
FIG. 9 is a top view of the connection member and connection guide.
Figure 10:
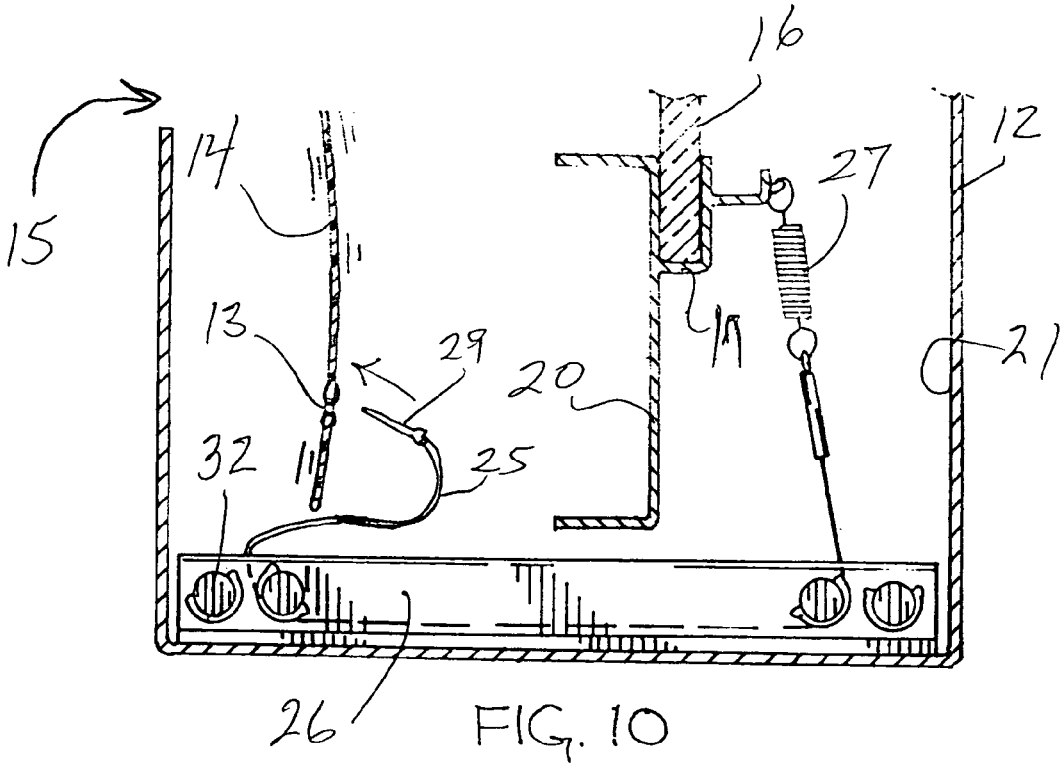
FIG. 10 is an enlarged side cross-sectional view showing a portion of the inner frame in the access condition and a graphics sheet ready for attachment within the light box display apparatus.
Figure 11:
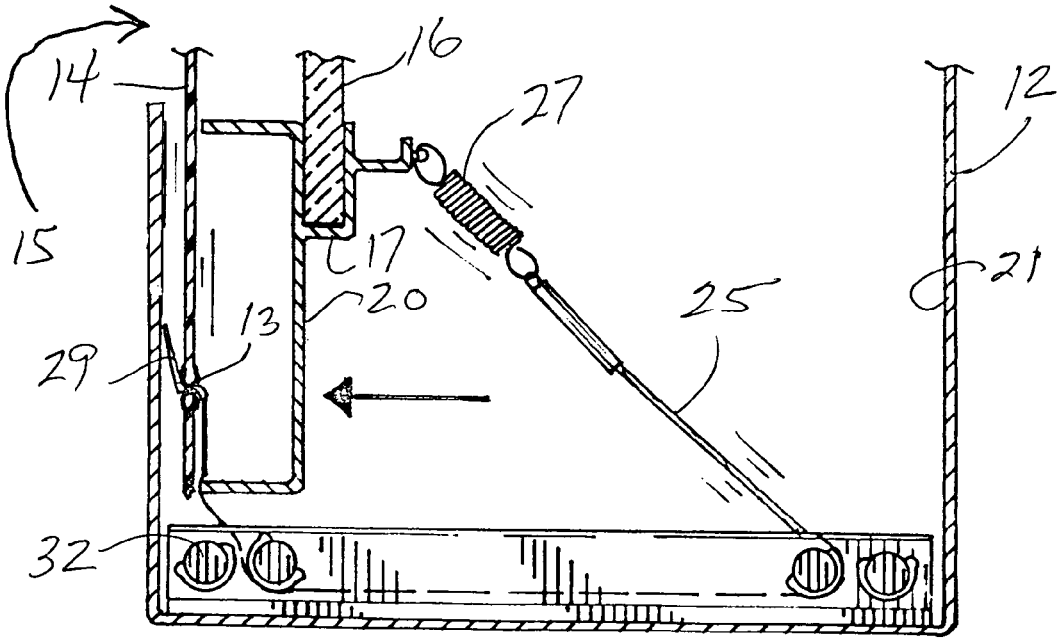
FIG. 11 is a view similar to FIG. 10, but showing the normal display condition.
Figure 12:
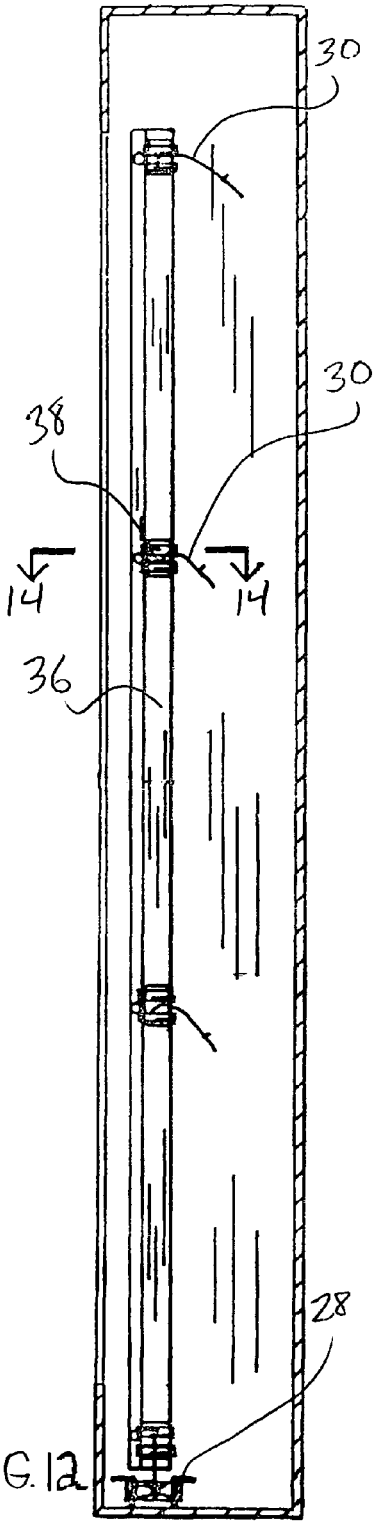
FIG. 12 is a cross-sectional side view showing the side connection members of the invention.
Figure 13:
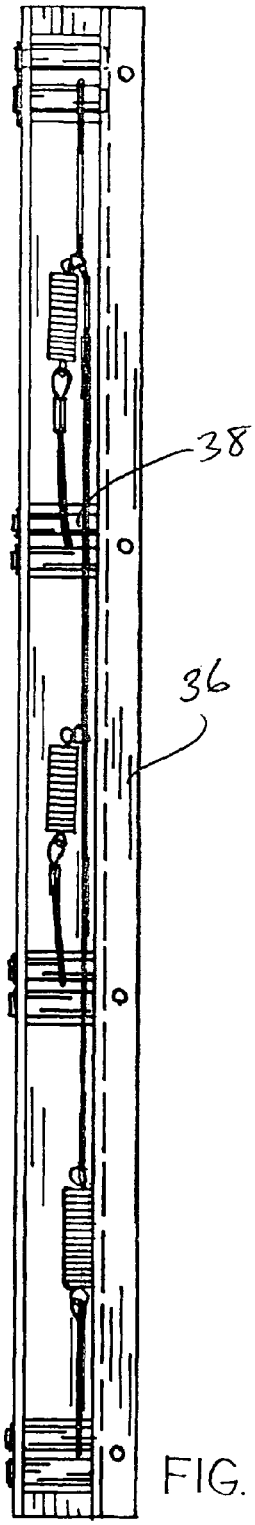
FIG. 13 is an enlarged interior side view of the side connection member interface.
Figure 14:
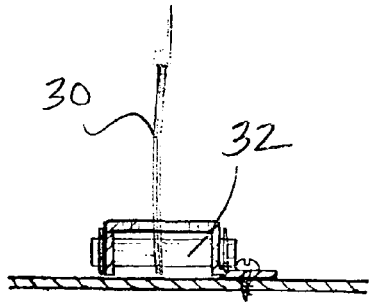
FIG. 14 is an enlarged cross-sectional view taken along lines 14-14 of FIG. 12.

Referring to FIGS. 3 through 7, it will be seen that the light box display apparatus 10 also comprises an inner frame 20 which is located entirely within the outer frame 12 and is almost as long as the interior of the outer frame and only slightly shorter in height. The inner frame is oriented to be substantially parallel to the interior back surface 21 and moveable between the back surface and the front opening 15. The inner frame 20 moves on a plurality of guide rails 24 positioned along the top and bottom interior surfaces of the outer frame 12. Movement of the inner frame 20 is controlled by a number of pneumatic pistons 22 which are interconnected between the inner frame 20 and the interior top and bottom surfaces of the outer frame 12 as shown bets in FIGS. 3, 4 and 5. FIGS. 6 and 7 respectively illustrate rearward and forward positions of the inner frame 20 within the outer frame 12.

Referring to FIGS. 8 through 11, it will be seen that apparatus 10 also comprises a plurality of spring-biased connection members 25 which are threaded through respective connection guides 26, the latter having a number of cylindrical rollers 32 for guiding the connection members 25 from the rear surface of inner frame 20 to the front thereof. Each such spring-biased connection member 25 includes a spring 27 and a retainer 29. The spring end of each connection member 25 is connected to the inner frame 20 at a diffuser bracket 17 which supports the diffuser sheet 16. The retainer end of the connection member 25 is threaded through a grommeted hole 13 along the edge portion of graphics sheet 14 as shown best in FIGS. 10 and 11. Those having skill in the art of light box displays, will understand from observing FIGS. 8 through 11, that as inner frame is moved away from front opening 15 and toward interior back surface 21 of outer frame 12, each connection member 25 becomes slack, thereby permitting retainer 29 to be released from grommeted hole 13 of graphics sheet 14. This connection member slacked condition is depicted best in FIG. 10. In this condition of apparatus 10, personnel may reach through front opening 15 and release graphics sheet 14 from inner frame 20, such as for replacement. Personnel may also gain access to fluorescent bulb tubes 18 and remove any one or more of them from their respective mating receptacles 19 such as for replacement.

On the other hand, it will be observed that as the inner frame 20 is moved toward the front opening 15, the connection members 25 become taut with the retainer 29 threaded through the grommeted holes 13 of graphics sheet 14. Thus, the graphics sheet 14 is subjected to a level of surface tension at various locations along the upper and lower surfaces of inner frame 20 thereby securing the graphics sheet in its appropriate position within the light box display apparatus 10.

Figure 4:
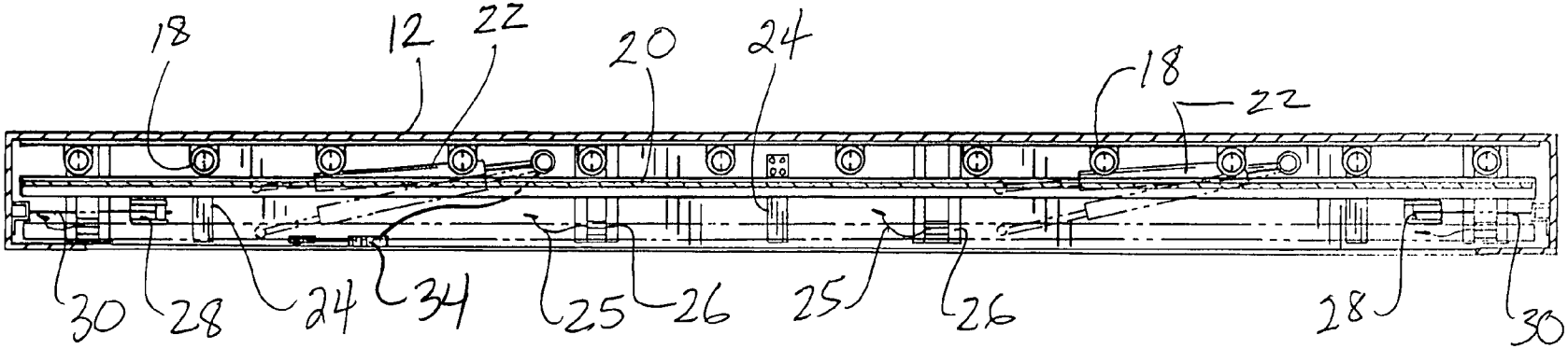
FIG. 4 is a downwardly directed cross-sectional view of the invention showing the inner frame moved toward the back of the apparatus to gain access to the interior.
Figure 5:
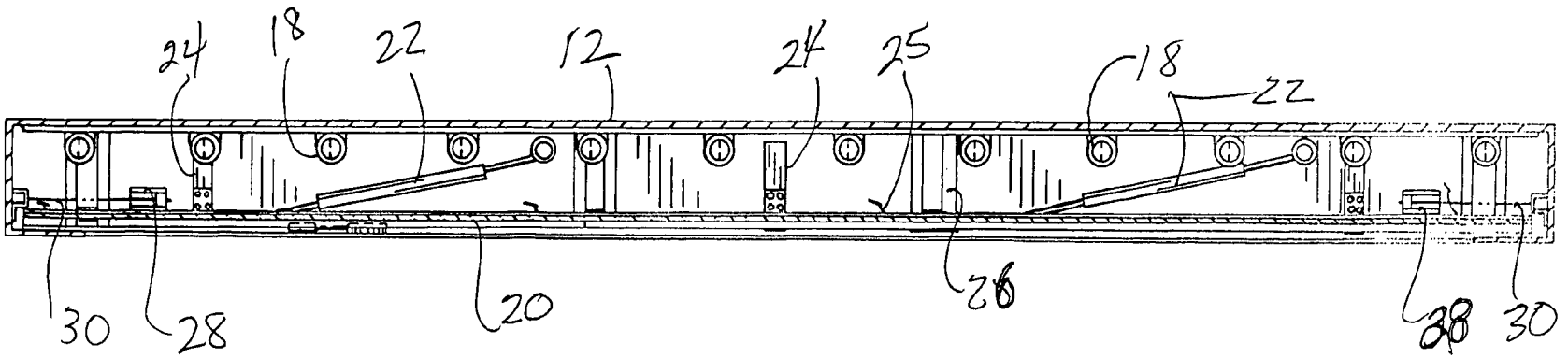
FIG. 5 is a cross-sectional view similar to that of FIG. 4 with the inner frame moved toward the front opening for normal display operation of the apparatus.
Figure 16:
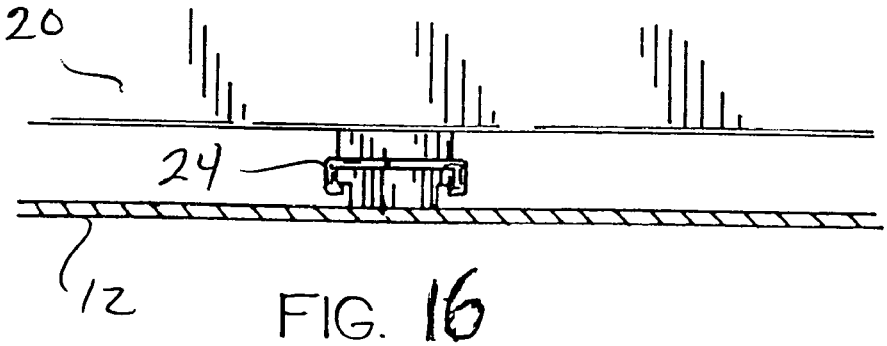
FIG. 16 is an enlarged view of an inner frame guide rail.

Movement of the inner frame 20 along guide rails 24 (see FIG. 16) is controlled by pistons 22, each of which provides a locking device 34 which permits personnel to lock the frame 20 along its path of motion when the frame 20 is closest to interior back surface 21 (See FIG. 4).

Figure 15:
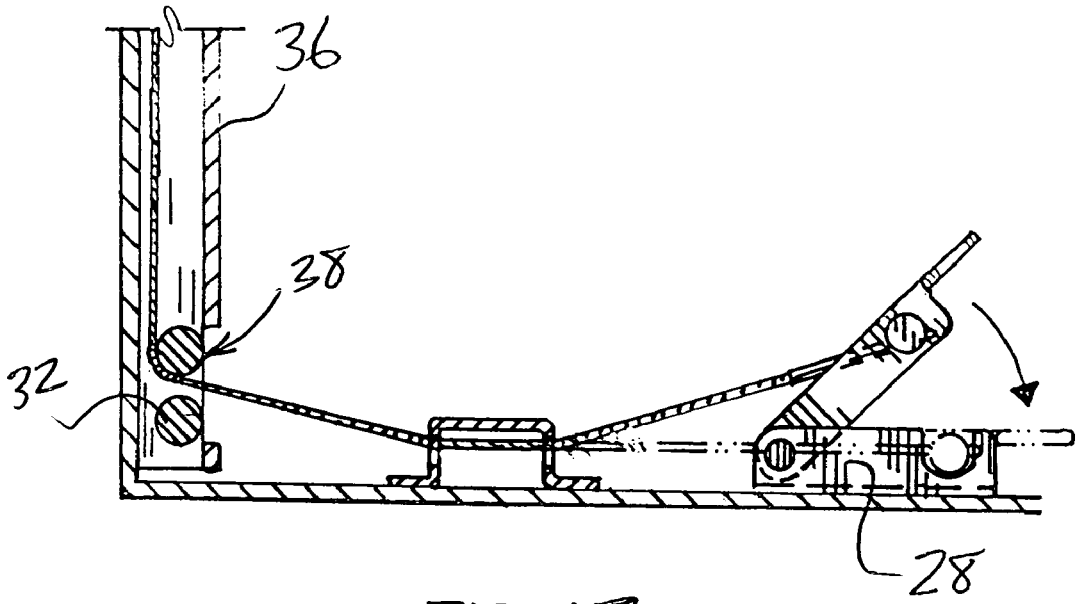
FIG. 15 is a cross-sectional plan view of the side connection member/latch interface.

The side edges of the graphics sheet 14 are also held in tension during normal display operation. As seen best in FIGS. 12 through 15, this is done somewhat differently in that side-connection members 30 are channeled through a channel bar 36 and respective connection guides 38 (each having rollers 32) to a manual latch 28 as shown in FIG. 15. Each side-connection member 30 is also spring-biased and provided with an end retainer to mate with a grommeted hole in the graphics sheet. However, the side connection members are not connected to the inner frame 20. It has been determined that manual latch 28 is the preferred means for controlling the side-directed tension on the graphics sheet 14 as opposed to the travel position of the inner frame 20. Therefore, when it is desired to release the graphics sheet 14 for replacement, as the inner frame is pushed back toward interior back surface 21, the latch 28 becomes accessible and is used to release the side tension after the inner frame is pushed to its fully rearward position.

Figure 17:
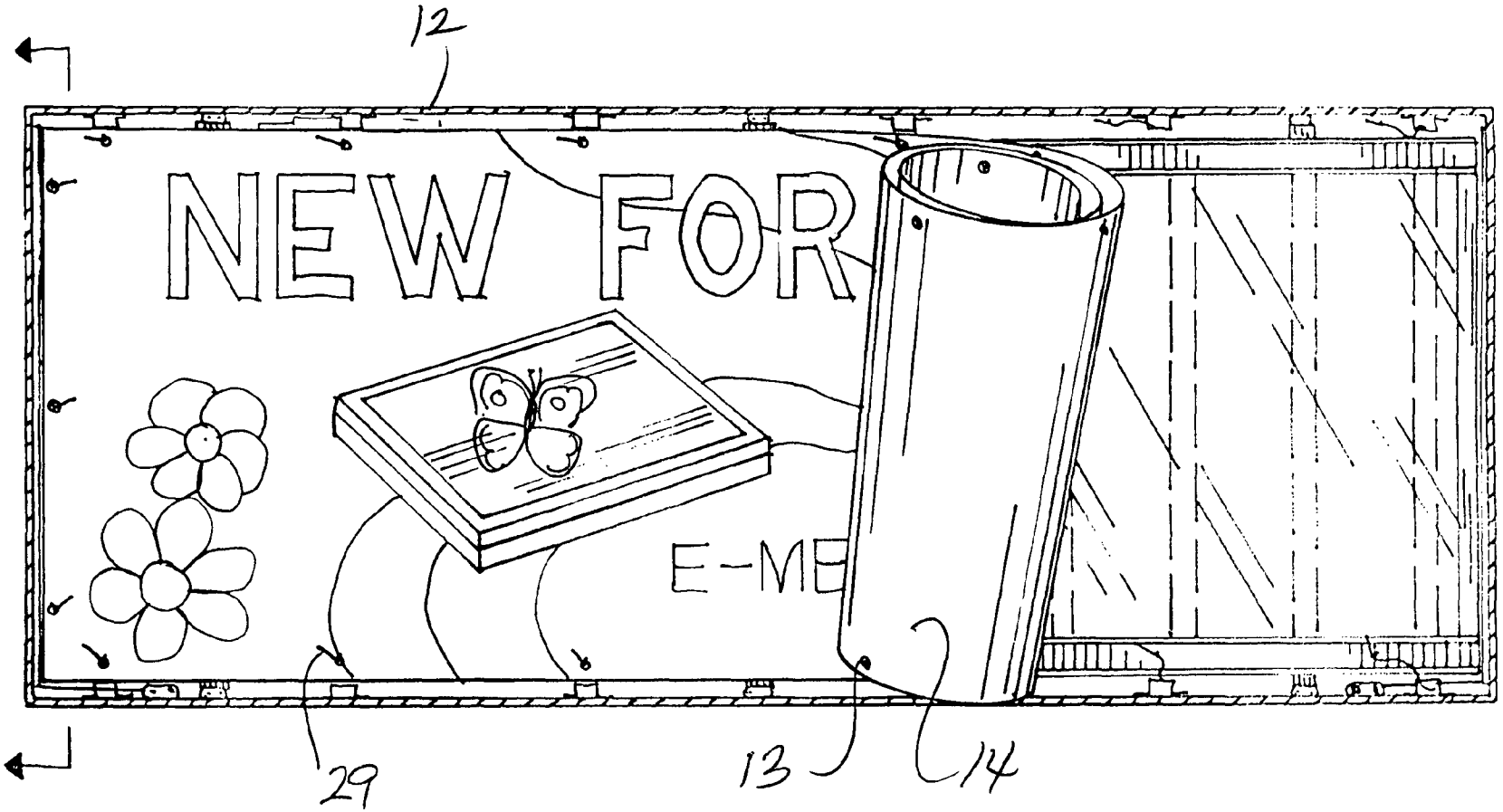
FIG. 17 is a plan view of the entire light box display apparatus shown during installation of a graphics sheet.

FIG. 17 illustrates installation of a new graphics sheet 14 while latch 28 is opened and inner frame 20 is in its access condition. Once all of the retainers 29 have been threaded through corresponding grommeted holes 13, the latch 28 is closed and the frame 20 is pushed to be flush with the front opening 15.

Having thus disclosed a preferred embodiment of the present invention to enable fabrication and operation of the inventive light box display apparatus, it will be evident that various modifications can be readily made. By way of example, the invention herein can be modified to accept graphics sheets that are placed in tension in other ways, or that are self-tensioned such as by being attached at their edges using a beaded edge captured in a trough-like recess of the margin of the inner frame, or which do not require tension at all. Such modifications would still benefit from the inventive feature herein of frontal access by means of a movable inner frame. Therefore, it will be apparent that the scope hereof is to be deemed limited only by the appended claims and not by the illustrative embodiment disclosed herein.

I claim:

1. A light box display apparatus having a housing forming an open front area within an outer frame defined by a back, a top, a bottom and opposed sides, the apparatus holding a fungible graphics sheet in front of a source of diffused light for observation through the open front area; the apparatus comprising:

a moveable inner frame within said housing, said inner frame being selectably moved along guide rails positioned between said open front area and said back; and a plurality of spring-biased connection members, each such member having an end secured to said inner frame and an end releasibly secured to said graphics sheet for subjecting said sheet to tension when said inner frame is moved toward said open front area and releasing said tension when said inner frame is moved toward said back.

2. The light box display apparatus recited in claim 1 wherein said spring-biased connection members are located at spaced intervals along inner surfaces of said top and bottom for applying said tension upwardly and downwardly along said graphics sheet.

3. The light box display apparatus recited in claim 1 further comprising at least one additional spring-biased connection member connected to said graphics sheet along an inner surface of each of said opposed sides and a latch connected to each said at least one additional spring-biased connection member and affixed to said outer frame for selectably applying tension to a respective side edge of said graphics sheet.

4. The light box display apparatus recited in claim 1 further comprising at least one pneumatic piston connected to said inner frame for controlling movement of said inner frame along said guide rails.

5. The light box display apparatus recited in claim 4 wherein said pneumatic piston comprises a mechanical lock for affixing said inner frame at a selected position along said guide rails.

6. The light box display apparatus recited in claim 1 wherein said graphics sheet comprises a plurality of grommeted holes for receiving said releasibly secured ends of said spring-biased connection members.

7. A light box display apparatus providing a frontal opening for access to a graphics sheet for replacement thereof, the apparatus having a housing forming an outer frame having an interior for receiving the graphics sheet and a diffused light source for transmitting light through the graphics sheet and the frontal opening; the apparatus comprising:

a translatable inner frame within said housing interior and moveable toward and away from said frontal opening;

a plurality of spring-biased connection members, each such member having a first end secured to said inner frame and a second end releasibly secured to said graphics sheet for applying tension to said sheet when said inner frame is moved toward said frontal opening and releasing said tension when said inner frame is moved away from said frontal opening.

8. The light box display apparatus recited in claim 7 wherein said spring-biased connection members are positioned along upper and lower interior surfaces of said outer frame.

9. The light box display apparatus recited in claim 7 further comprising said spring-biased connection members positioned along side interior surfaces of said outer frame and connected to said graphics sheet; and a latch receiving said side spring-biased connection members for selectably pulling said graphics sheet toward sides of said outer frame.

10. The light box display apparatus recited in claim 7 and further comprising at least one pneumatic piston affixed to said inner frame and to said outer frame for controlling movement of said inner frame relative to said outer frame.

11. The light box display apparatus recited in claim 10 wherein said at least one pneumatic piston comprises a locking device for locking said inner frame at a selected position relative to said outer frame.

12. The light box display apparatus recited in claim 7 wherein said graphics sheet comprises a plurality of grommeted holes for receiving said second end of each of said spring-biased connection members.

13. A light box display apparatus comprising:

an outer frame having a frontal opening providing access to the interior of said outer frame; and an inner frame positioned within said outer frame interior and moveable toward and away from said frontal opening;

a movement control mechanism for selectably preventing movement of said inner frame relative to said outer frame after said inner frame has been moved away from said frontal opening; and a diffused light source positioned in said outer frame for transmission of light toward said opening.

14. A light box display apparatus comprising:

an outer frame having a frontal opening providing access to the interior of said outer frame; and an inner frame positioned within said outer frame interior and moveable toward and away from said frontal opening;

a graphics sheet releasibly affixed to said inner frame for movement therewith and a plurality of spring-biased connection members interconnecting said graphics sheet and said inner frame to apply increasing surface tension to said graphics sheet as said inner frame is moved toward said frontal opening; and a diffused light source positioned in said outer frame for transmission of light toward said opening.

15. A light box display apparatus comprising:

an outer frame having a frontal opening providing access to the interior of said outer frame; and an inner frame positioned within said outer frame interior and moveable toward and away from said frontal opening;

a graphics sheet releasably affixed to said inner frame for movement therewith and a plurality of spring-biased connection members interconnecting said graphics sheet and said inner frame to apply increasing surface tension to said graphics sheet as said inner frame is moved toward said frontal opening; and wherein said graphics sheet comprises a plurality of grommeted holes for receiving said spring-biased connection members.

* * * * *